US007209096B2

(12) United States Patent
Chau

(10) Patent No.: US 7,209,096 B2
(45) Date of Patent: Apr. 24, 2007

(54) LOW VISIBILITY DUAL BAND ANTENNA WITH DUAL POLARIZATION

(75) Inventor: Tam Hung Chau, Berkeley, IL (US)

(73) Assignee: Antenex, Inc., Schaumburg, IL (US)

( * ) Notice: Subject to any disclaimer, the term of this patent is extended or adjusted under 35 U.S.C. 154(b) by 27 days.

(21) Appl. No.: 11/040,860

(22) Filed: Jan. 21, 2005

(65) Prior Publication Data

US 2005/0200554 A1 Sep. 15, 2005

Related U.S. Application Data

(60) Provisional application No. 60/538,685, filed on Jan. 22, 2004.

(51) Int. Cl.
*H01Q 1/36* (2006.01)
*H01Q 1/24* (2006.01)

(52) U.S. Cl. ..... 343/895; 343/702

(58) Field of Classification Search ..... 343/702, 343/895, 872
See application file for complete search history.

(56) References Cited

U.S. PATENT DOCUMENTS

| | | | | |
|---|---|---|---|---|
| 1,581,133 | A | 4/1926 | Mackenzie | 267/74 |
| 1,911,234 | A | 5/1933 | Meyer | 343/823 |
| 2,094,108 | A | 9/1937 | Ryall | 179/78 |
| 2,712,604 | A | 7/1955 | Thomas, Jr. et al. | 250/33 |
| 2,802,210 | A | 8/1957 | Berndt | 343/792 |
| 2,945,084 | A | 7/1960 | Daggett | 174/86 |
| 2,953,786 | A | 9/1960 | Krause | 343/895 |
| 2,963,704 | A | 12/1960 | Yates et al. | 343/895 |
| 2,966,678 | A | 12/1960 | Harris | 343/809 |
| 2,966,679 | A | 12/1960 | Harris | 343/895 |
| 3,199,108 | A | 8/1965 | Munk | 343/718 |
| 3,246,245 | A | 4/1966 | Turner | 325/442 |
| 3,264,647 | A | 8/1966 | Nuttle | 343/745 |
| 3,296,536 | A | 1/1967 | Copeland et al. | 325/449 |
| 3,383,695 | A | 5/1968 | Jarek | 343/895 |
| 3,386,033 | A | 5/1968 | Copeland et al. | 325/373 |
| 3,396,396 | A | 8/1968 | Charlton et al. | 343/708 |
| 3,474,453 | A | 10/1969 | Ireland | 343/745 |
| 3,487,463 | A | 12/1969 | Rogers | 343/708 |
| 3,523,251 | A | 8/1970 | Halstead | 325/373 |
| 3,623,113 | A | 11/1971 | Faigen et al. | 343/747 |

(Continued)

OTHER PUBLICATIONS

Kuboyama, Haruhiro et al., "Experimental Results with Mobile Antennas Having Cross-Polarization Components in Urban and Rural Areas," *IEEE Transactions on Vehicular Technology*, vol. 39, No. 2, 150-160, 1990.

*Primary Examiner*—Shih-Chao Chen
(74) *Attorney, Agent, or Firm*—Cislo & Thomas LLP

(57) ABSTRACT

A low visibility, field-diverse, dual band antenna provides cross-polarized fields enhancing signal communications. A generally flat, but helical, antenna is achieved in conjunction with a core substrate about which the antenna is wrapped, wound, or fixed. The core substrate, pitch or angle of the helix, and length of the transmitting antenna are chosen for a specific two (2) selected resonant frequency. A two-pole low-pass filter may be used to achieve dual band transmission. The passive components are specifically selected to achieve two (2) resonant frequencies PCS/Cellular 821–896 MHz and 1850–1990 MHz. The length and width of the helix are chosen in order to dimension the helical antenna between its linear and circular polarization modes to thereby deliver field-diverse and cross-polarized transmission modes.

32 Claims, 4 Drawing Sheets

U.S. PATENT DOCUMENTS

| | | | | |
|---|---|---|---|---|
| 3,624,662 | A | 11/1971 | Feder | 343/715 |
| 3,720,874 | A | 3/1973 | Gorcik et al. | 325/16 |
| 3,781,899 | A | 12/1973 | Lockwood | 343/880 |
| 3,858,220 | A | 12/1974 | Arnow | 343/802 |
| 3,932,873 | A | 1/1976 | Garcia | 343/792 |
| 3,961,332 | A | 6/1976 | Middlemark | 343/802 |
| 4,028,704 | A | 6/1977 | Blass | 343/715 |
| 4,117,493 | A | 9/1978 | Altmayer | 343/750 |
| 4,117,495 | A | 9/1978 | Hochstein | 343/877 |
| 4,163,981 | A | 8/1979 | Wilson | 343/715 |
| 4,229,743 | A | 10/1980 | Vo et al. | 343/749 |
| 4,442,436 | A | 4/1984 | Newcomb | 343/722 |
| 4,442,438 | A | 4/1984 | Siwiak et al. | 343/792 |
| 4,494,117 | A | 1/1985 | Coleman | 343/365 |
| 4,494,120 | A | 1/1985 | Gary | 343/702 |
| 4,494,122 | A | 1/1985 | Garay et al. | 343/722 |
| 4,504,834 | A | 3/1985 | Garay et al. | 343/749 |
| 4,571,595 | A | 2/1986 | Phillips et al. | 343/745 |
| 4,730,195 | A | 3/1988 | Phillips et al. | 343/792 |
| 4,849,767 | A | 7/1989 | Naitou | 343/745 |
| 5,300,940 | A | 4/1994 | Simmons | 343/749 |
| 5,412,392 | A | 5/1995 | Tsunekawa | 343/702 |
| 5,977,931 | A | 11/1999 | Openlander | 343/895 |
| 5,990,848 | A * | 11/1999 | Annamaa et al. | 343/895 |
| 6,127,979 | A * | 10/2000 | Zhou et al. | 343/702 |
| 6,292,156 | B1 | 9/2001 | Openlander | 343/895 |
| 6,653,987 | B1 * | 11/2003 | Lamensdorf et al. | 343/895 |
| 6,720,935 | B2 * | 4/2004 | Lamensdorf et al. | 343/895 |

* cited by examiner

LOW VISIBILITY DUAL BAND ANTENNA WITH DUAL POLARIZATION

COPYRIGHT AUTHORIZATION

Portions of the disclosure of this patent document may contain material which is subject to copyright and/or mask work protection. The copyright and/or mask work owner has no objection to the facsimile reproduction by anyone of the patent document or the patent disclosure, as it appears in the Patent and Trademark Office patent file or records, but otherwise reserves all copyright and/or mask work rights whatsoever.

CROSS-REFERENCES TO RELATED APPLICATIONS

This patent application is related to and claims priority from U.S. Provisional Patent Application Ser. No. 60/538,685 filed Jan. 22, 2004 entitled Low Visibility Dual Band Radio Antenna With Dual Polarization which application is incorporated herein by this reference thereto.

BACKGROUND OF THE INVENTION

1. Field of the Invention

This invention relates to antennae and more particularly a dual band antenna that uses cross-polarization with either a ground plane or no ground plane to provide enhanced telecommunications or the like.

2. Description of the Related Art

Most, if not all, forms of radio or similar telecommunications generally require an antenna in order to transmit and receive radio waves and the like for communication. With increasing cellular communications and short-distance telecommunications, antennae are becoming more a part of the commonplace environment. Particularly with cellular telephones, the power supplies for the antenna associated with the cellular phone is powered by a battery and is consequently limited in power and duration of the power supply. Due to these power and other limitations, it is important to provide an antenna that maximizes the efficiency of the available power, to transmit a clear signal as far as possible.

Stationary and other antennae, such as those mounted on cars and the like, are generally within easy reach of passersby or pedestrians. Such easy access makes such antennae often subject to vandalism or other unwanted attention. By making such antennae as inconspicuous as possible, undesired attention can be avoided and the useful life of the antenna can be extended. In order to achieve low visibility, the antenna must achieve a compact size through packaging and possibly disguised or non-traditional antenna shapes.

In the art, it is known that destructive interference occurs when reflected signals destructively interfere with transmitted signals. This is known Raleigh fading and creates signal fading or dead spots that inhibit or diminish the desired communications for which cellular phones and the like are intended. In designing an antenna meant for daily or commonplace use in a cellular or similar environment, an advantageous antenna design avoiding Raleigh fading is not currently available and is something that would well serve the advancement of the telecommunications arts.

In order to decrease the apparent size of a monopole antenna, the antenna can be shortened by making the antenna in the shape of a spring, or coil, by winding it around a cylindrical core in the manner of a helix or otherwise. Such helical antennae are described in detail in Kraus, *Antennas*, Chapter 7, pp. 173–216 (McGraw Hill 1950) and in a number of U.S. patents. A practical example of a linearly polarized antenna may be found in the *ARRL Antenna Handbook*, "Short Continuously Loaded Vertical Antennas," pp. 6–18 to 6–19 (Gerald Hall ed., ARRL Press 1991).

Helical antennae may be made from wire or metal tape wrapped around a cylindrical core made of plastic or plastic-glass composite. In winding the antenna around the core, the length of the antenna and the pitch at which it is wound around the core are fashioned so that the resulting antenna is resonant at a desired frequency. A shortened antenna has the radiation resistance and consequent narrow band width of a straight length wire of the same length. However, with the coiling of the wire about the core, an inductance is introduced that approximately cancels the series radiation capacitance of the equivalent short wire antenna.

The narrow bandwidth of such inductively shortened antennae can be used to good effect at frequencies below 30 MHz, where they enjoy frequent use. However, at higher frequencies, wider bandwidths are required and the narrow bandwidth of such antennae prevent them from being used at such higher frequencies. In order to compensate for the narrow bandwidth of the inductively-shortened antenna, common practice includes tuning means so that the frequency may be tuned by either expanding or contracting the length of the helix, or by adding resistances in series with the low radiation resistance of the antenna. This is shown in the patent to Simmons, Broadband [Helical] Antenna (U.S. Pat. No. 5,300,940 issued Apr. 5, 1994). By accommodating and compensating for the narrow bandwidth, an improvement in the apparent bandwidth in the VSWR (voltage standing wave ratio) of the antenna but at the expense of radiation efficiency. Of course, radiation efficiency is especially important for battery-powered transmitters and for those transmitters that are a significant distance (near the periphery of the transmitting range) from a cellular or other receiver.

Where tuning is impractical and/or where high efficiency is required, some additional bandwidth may be gained by making the helix larger in diameter thereby increasing the width to length ratio. However, as mentioned in the Kraus reference above, as the diameter of the helix is increased and as the pitch and length of the turns are adjusted to maintain the resonance of the antenna, the polarization of the resulting antenna changes from dispersive linear radiation to endfire circular radiation. This change of direction of radiation from broadside to endfire is generally impractical for mobile and portable applications. Such high directivity and such an unfavored angle of radiation impose certain inconveniences and limitations upon small transmitters and their antennae. However, there are some uses for an endfiring helical antenna such as those which are described in the patent to Wheeler entitled Antenna Systems (U.S. Pat. No. 2,495,399 issued January 1950).

Field diversity, that is the diversity in the polarization of the vertical and horizontal field components, is known to address and to help resolve Raleigh fading. K. Fujimoto and J. R. James, *Mobile Antenna Systems Handbook*, pp. 78–85 (Artech House 1994), A. Santamaria and F. J. Lopez-Hernandez, *Wireless LAN Systems*, p. 180 (Artech House 1994). The advantages arising from cross-polarized radio signals is also addressed in "Experimental Results with Mobile Antennas Having Cross-Polarization Components in Urban and Rural Areas," Kuboyama et al., *IEEE Transactions on Vehicular Technology*, Vol. 39, No. 2, May 1990, pp. 150–160. Field diversity, or cross polarization, results when the horizontal and vertical field components of the radiated signal are radiated in phase. This is in opposition to circular polarization, which occurs when the horizontal and vertical field components are plus or minus 90 degrees (90°) out of phase and to the situations where only horizontal or vertical field components are present exclusively.

In order to obtain field diversity from an antenna, particularly a helical antenna, the helical antenna must be dimensioned between its linear and circular polarization modes in order to achieve field diversity. One such helical antenna is illustrated in FIG. 1 of the patent to Halstead, Structure with an Integrated Amplifier Responsive to Signals of Varied Polarization (U.S. Pat. No. 3,523,351 issued August 1970). As an alternative to the helical structure of the antenna, meander lines can be used as set forth in the patent to Drewett, Helical Radio Antenna (U.S. Pat. No. 4,160,979 issued Jul. 10, 1979). Radomes are also known in the art per the patent to Frese, Helical UHF Transmitting and Receiving Antenna (U.S. Pat. No. 5,146,235 issued Sep. 8, 1992).

Despite the established art and current developments thereof, the use of field diversity in a small antenna for cellular or similar use is not known in the art. Additionally, such antennae would provide significant advantage as radio telecommunications could then also take place in conjunction with a variety of different objects such as vending machines, as well as individuals with their cellular phones and other electronic data and information machines. To achieve greater utility, such an antenna should function well with or without ground planes and should provide impedance matching and compensating circuitry to maximize the bandwidth of the antenna.

Prior attempts may have been made in the art with respect to dual band antennae having low visibility and otherwise. Two such attempts are the patents to Openlander, U.S. Pat. No. 5,977,931 issued Nov. 2, 1999 and entitled Low Visibility Radio Antenna with Dual Polarization and U.S. Pat. No. 6,292,156 issued Sep. 18, 2001 and entitled Low Visibility Radio Antenna with Dual Polarization, both of which are incorporated herein by this reference.

While the brief descriptions set forth above are believed to be accurate, no admission is made by them regarding their subject matter which is solely defined by the patent or reference involved.

SUMMARY OF THE INVENTION

In view of the foregoing disadvantages and/or limitations inherent in the known types of antennae now present in the prior art, the present invention provides a new dual band antenna wherein the same can be used for two separate frequency regimes.

The general purpose of the present invention, which will be described subsequently in greater detail, is to provide a wireless or cellular antenna that enables use for at least two different frequency bands which is not anticipated, rendered obvious, suggested, taught, or even implied by any of the prior art antennae, either alone or in any combination thereof.

While the schematics in FIGS. 1A and 1B show a single band antenna resonant circuit model along the lines of the prior U.S. patents to Openlander, U.S. Pat. Nos. 6,292,156 and 5,977,931. These circuits use a single capacitor, or a single inductor, shunt to ground matching technique to achieve a single selected frequency range.

In the FIG. 2 schematic, an exemplary embodiment for the dual band antenna resonant circuit model may utilize two capacitors separated by a microstrip and conducting foil, or an inductor design matching technique, to achieve two selected resonant frequencies, generally PCS/Cellular 821–896 MHz and 1850–1990 MHz. This exemplary embodiment dual band antenna resonant circuit model may also be scaled or modified to for two or more other, selected resonant frequencies.

The low visibility, field diverse radio dual band antenna of the present invention transmits and receives its signals using dual polarization to obtain field diversity. A generally small (on the order of a few inches), thin, and rectangular printed circuit board is wrapped with conducting foil or the like with plated-through holes providing conduction between the two large flat sides of the rectangle. The dual band antenna is wound about the substrate for two preferred resonant frequencies. Alternatively, foil can be laid in between offset plated-through holes in order to obtain the helix configuration. The plated-through holes provide easy means by which such an antenna can be fabricated as upon application of the antenna foil, the margin of the substrate external to the plated-through holes can be removed by sawing, routing, or stamping.

The flat helix configuration is generally rectangular in shape and delivers a field diverse transmission signature that diminishes Raleigh fading, signal fading, and dead spots. The dimensions of the resulting field diverse dual band antenna are important as they establish the two base resonant frequencies about which the antenna will naturally resonate. A radome enclosure is used to encapsulate and cover the antenna and may serve to camouflage or disguise the antenna so that it attracts less attention and will be less subject to vandalism or mischief. The radome may be cylindrical or rectangular in nature according to the dimensions of the enclosed antenna. Industry standard mounts can be used in conjunction with the constant impedance section to eliminate the need for impedance matching or allow convenient attachment of alternative or additional impedance matching networks. In the embodiment described herein, elevation of the antenna somewhat above the ground plane lowers the radiation angle.

Tuning of the dual band antenna is achieved using a dual matching technique from the two shunt capacitors and a conducting foil or inductor (as illustrated in FIG. 2) at strategic places in the antenna circuit to achieve two resonant frequencies. Also, the two-selected operating frequencies of the antenna can be changed by the thickness of the covering plastic radome. This is particularly true if the radome is constructed of a dense plastic such as Chimei brand of ABS-and/or acetal (often marketed under the brand name of Delrin®) having a dielectric constant of about 4 to 5. ABS (Acrylonitrile Butadiene Styrene) thermoplastic may be used for injection molding the radome that houses the antenna. "T-Grade" ABS to mold mobile antenna radomes has been found to be useful.

In order to optimize the antenna-manufacturing process, holes may be created within the substrate. These holes are plated with conducting material so that conducting foil on opposite faces of the substrate may be electrically connected. The holes may be offset according to the pitch of the helix. Once the transmitting antenna has been fabricated upon the core substrate, the margin between the plated-through holes and the edge of the substrate may be separated by cutting, sawing, or stamping.

Specific embodiments of the antenna of the present invention and are described in further detail below.

In one embodiment, a low-visibility, field-diverse dual band monopole antenna for providing communications is set forth having an antenna-supporting core comprising printed circuit board (PCB) substrate and having a width and a length. An antenna is wrapped upon the core in a manner for two selected dual band resonant frequencies with the antenna radiating in a diverse manner with horizontal and vertical field components of a field radiated by the antenna substantially in phase and not circularly polarized. The low-visibility, field-diverse dual band antenna then has helical antenna characteristics without severe circular polarization radiation thereby promoting reliable communications;

In another embodiment, a low-visibility, field-diverse antenna for providing communications has a generally thin and approximately square antenna-supporting core comprising printed circuit board (PCB) substrate having a width and a length, the core conducting from one flat side to another via at least a portion of a plated-through hole in the core. An antenna having conducting foil is fixed upon the core in a manner for two selected dual band resonant PCS/Cellular frequencies at 821–896 MHz and 1850–1990 MHz. The antenna radiates in a diverse manner with horizontal and vertical field components of a field radiated by the antenna substantially in phase and not circularly polarized. The antenna has a two-pole low-pass filter that enables operation at the two selected resonant frequencies. The filter includes: a first capacitor shunted to ground and in parallel to an input to the antenna, an adjustable inductor coupled to the first capacitor and in series with the antenna input, and a second capacitor coupled to the adjustable inductor on a side of the adjustable inductor opposite that of the input. The second capacitor is shunted to ground and in parallel to the first capacitor such that the two selected resonant frequencies are enabled for transmission by the antenna.

The first capacitor is an approximately 1 pf at 1 kV ceramic capacitor. The adjustable inductor is a manually-adjustable brass ribbon or sheet. The second capacitor is an approximately 1.5 pf at 1 kV ceramic capacitor.

The antenna terminates in an extended area of conductor having a width generally greater than that of the conducting foil, the extended area covers an end of the antenna-supporting core such that the low-visibility, field-diverse dual band antenna is realized having helical antenna characteristics without severe circular polarization radiation thereby promoting reliable communications.

In another embodiment, a method for constructing a low-visibility, field-diverse dual band monopole antenna includes the steps of: providing an antenna-supporting core, providing a conductor, fixing the conductor upon the core, and attaching the conductor to the core in a manner whereby a length of the conductor is engaged by the core in a manner for two selected dual band resonant frequencies, the conductor radiating in a diverse manner with horizontal and vertical field components of a field radiated by the conductor substantially in phase and not circularly polarized such that the low-visibility, field-diverse dual band antenna is realized having helical antenna characteristics without severe circular polarization radiation thereby promoting reliable communications.

OBJECTS OF THE INVENTION

It is an object of the present invention to provide a low visibility dual band antenna that avoids Raleigh fading during transmission, which is an improvement of the original invention as set forth in U.S. Pat. No. 5,977,931.

It is an additional object of the present invention to provide a low visibility dual band antenna that radiates in a field diverse manner.

It is yet another object of the present invention to provide a method of manufacturing a low visibility field diverse dual band antenna.

It is an object of the present invention to provide a low visibility field diverse dual band antenna that matches industry standard connections, can achieve an impedance matching network, and that can maximize radiative efficiencies.

These and other objects and advantages of the present invention will be apparent from a review of the following specification and accompanying drawings. The foregoing objects are some of but a few of the goals sought to be attained by the present invention.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

The present invention provides means by which small, low-power antennae can achieve better signal transmission and power efficiencies while avoiding intentional or mischievous destruction or damage.

Figure 4A:
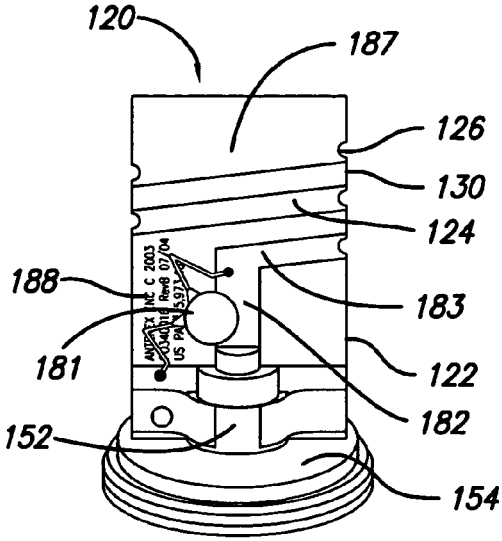
FIG. 4A is a top view of a dual band antenna constructed according to the present invention.
Figure 4B:
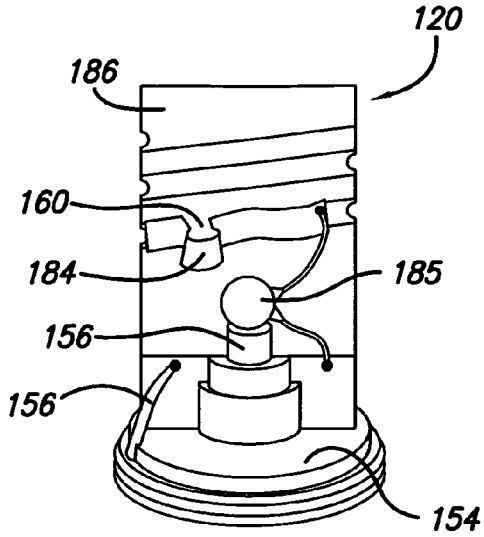
FIG. 4B is a bottom view of a dual band antenna constructed according to the present invention.

As shown in FIGS. 4A and 4B, the low visibility, field diverse antenna of the present invention 120 has a rigid supporting substrate 122 upon which a conductor 124 (such as conducting metal foil) is applied, attached, fixed, or wound. In this way, a relatively long length of conductor (acting as the transmitting antenna) can be held or enclosed in a generally small space. As the length of the transmitting antenna generally determines the resonant frequency, providing a helical, coiled, or otherwise wound conductor 124 in a small space provides for lower visibility and a diminished chance of vandalism and mischief directed against the mechanical structure of the antenna.

While the conductor 124 of the antenna 120 may be wound about the perimeter of the rigid supporting substrate 122, in the preferred embodiment, holes 126 may be inscribed, drilled, or otherwise installed into the supporting substrate 122. After the holes 126 have been created in the substrate 122, the interiors of the holes 126 are plated or otherwise made conducting so that when the conductor 124 comes into contact with the plating, conduction can be achieved from one flat side of the substrate 122 to the other.

As shown in FIGS. 4A and 4B, strips of conducting foil 124 travel along the front side of the substrate 122 with corresponding foil strips 124 traveling on the back side of the substrate 122.

In order to obtain a helical configuration by the conductor 124 as it travels along the exterior of the substrate 122, the holes 126 are offset according to the angle of pitch that the helix formed by the conductor 124 obtains when it is affixed to the substrate. This angle of pitch is important as it controls the measure of induction that the helix obtains as an inductor. The permittivity and/or permeability of the substrate 122 may also be a factor of the magnitude of the inductive effect created by the helical conductor 124 and may be accommodated by the offset of the holes 126.

As described in the prior U.S. patents to Openlander, U.S. Pat. Nos. 6,292,156 and 5,977,931 (both of which are incorporated herein), the holes 126 intermediating the strips of conductor 124 to achieve the helical transmitting antenna, are situated in a spaced apart relation with an outermost edge of the substrate 122 to create a margin separating the edge of the substrate 122 from the holes 126.

Upon completion of the antenna affixing process where the conducting foil 124 is fixed to the opposite faces of the substrate 122 and intermediated by the plated-through holes 126, the margin can be removed from the center portion of substrate 122. This removal process generally entails cutting the margin off from the center portion along the center of the holes 126. Additional margin may be cut away by expanding the margin and increasing the center portion during the cutting process so long as the conducting foil 124 is not torn; broken, or otherwise injured. The holes 126 may be made of sufficiently large diameter, on the order of one hundred thousandths of an inch (0.100"), to make removal of the margin easier. With such diameter holes 126, the cutting, sawing, or stamping process does little damage to the connecting foil and expensive tooling is not needed to reduce the size of the antenna 120 by removing the margin.

Having properly chosen the dimensions and properly applied the materials of the antenna 120 as shown in FIGS. 4A and 4B, the predominant portion of the antenna has been created. The pitch and width of the helix, the length and width of the conductor 124, the permittivity and permeability of the substrate 122, as well as the frequencies involved all affect the operating characteristics of the antenna of the current invention and provide means by which such antennae may be tuned by altering the characteristics of these and other parameters. While simple in construction, the antenna 120 constructed along the lines of the present invention is electronically sophisticated and reflects this sophistication in its transmission characteristics of field diversity coupled with low visibility and energy efficiency. By providing a low visibility field diverse dual band antenna transmitting in a plurality of polarities, Raleigh fading, signal fading, and dead spots are reduced by avoiding destructive interference while signal transmission is correspondingly enhanced in accordance with the power restrictions for weak or low power transmitters. By providing such a dual band antenna, cellular and other personal communications become greatly enhanced as they are more reliable within the confines of the power restrictions involved.

Figure 4C:
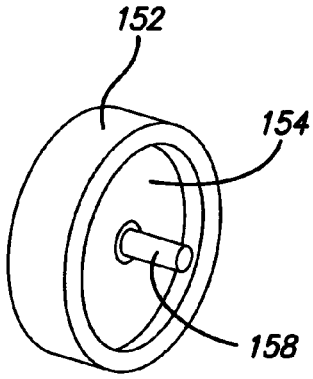
FIG. 4C is a pin connection or bottom view of a dual band antenna constructed according to the present invention.

FIGS. 4A, 4B, and 4C show different views of the antenna of the current invention implementing a radome (FIG. 4D) as well as a grounding rail (which helps to maintain constant the impedance of the antenna circuit), a center insulator, a grounding ring, and a center connecting pin for standard connection to standard antenna-receiving sockets and the like.

In FIGS. 4A, 4B, and 4C, an antenna 120 constructed along the lines set forth above in conformance with the present invention is shown in conjunction with a radome 150, a grounding ring 152, a center insulator 154, a grounding rail 190 (connected by a ground wire 156) may provide support to antenna structure 120. A center connecting pin 158 may connect to center conductor 182 through connector bushing 192.

The radome 150 (FIG. 4D) is formed in a shape generally along the lines of the antenna 120. As the antenna 120 is generally rectangular or square in shape, the radome 150 may likewise be rectangular, square, or circle in shape and generally thin in order to provide the lowest profile possible for the low visibility field diverse dual band antenna of the present invention. The radome 150 should be constructed of weatherproof and weathertight materials such as dense plastic or the like. Additionally, such plastics may change the operating characteristics of the signals transmitted by the antenna 120. Particularly, it is known that dense plastics with a dielectric constant of 4 (such as dense acetal plastics marketed under the brand name Delrin®), alter the operating frequency of the antenna. Such a feature may generally be taken into account in the construction and design of the present invention.

The radome 150 may be attached to a standard base known in the industry for easy connection of the antenna 120 to industry standard mounts. In conjunction with the attachment of the radome 150 to such a base, accompanying performance-enhancing components or elements can be added to the antenna of the present invention to increase and maximize its performance.

A grounding rail 190 connected by a ground wire 156 may be added to provide the ground for the antenna 120. However, it is contemplated that the dual band antenna of the present invention may be used with or without a ground plane and still perform well to deliver good signal transmission and communications. The grounding ring 152 may incorporate or provide a constant impedance circuit thereby widening the operating bandwidth of the transmitting antenna 120. As mentioned above, monopole antennae generally have a narrow bandwidth. By providing a bandwidth-broadening constant impedance section, the utility and operating bandwidth of the antenna of the present invention is enhanced. Additionally, signal energy impressed upon the antenna 120 is more likely to be transmitted than reflected.

The use of the ground ring 152 with a constant impedance section may eliminate the need for impedance matching in some antenna configurations and may allow for the convenient attachment of impedance matching networks and other circuits. The grounding ring 152 may be toroidal or linear in nature and manufactured of materials known in the art. A central aperture or hole may be present in a toroidal grounding ring which may provide room for a similarly circular projection projecting from a center insulator 154. The center insulator 154 (FIG. 4C) may also be circular in nature to provide a foundation upon which the grounding ring 152 rests and may be engaged by the center insulator's circular projection 172. A grounding ring 152 may underlie the center insulator 154 and provide a means by which attachment can be made between the plastic insulator radome 150 and a standard industry mount or other mount.

A center connecting pin 158 (FIG. 4C), coupled to a connector bushing 192 (generally common in the art) and connecting the transmitter to the dual band antenna, may pass through the grounding ring 152 to attach to the antenna 120 via the grounding wire 156, the grounding rail 190, or otherwise. The connection of the center connecting pin 158 with any intermediating network provided by the grounding ring 152 or otherwise serves to couple the transmitter to the antenna so that the enhanced operating characteristics of the antenna 120 are available to the transmitter (not shown).

Figure 3A:
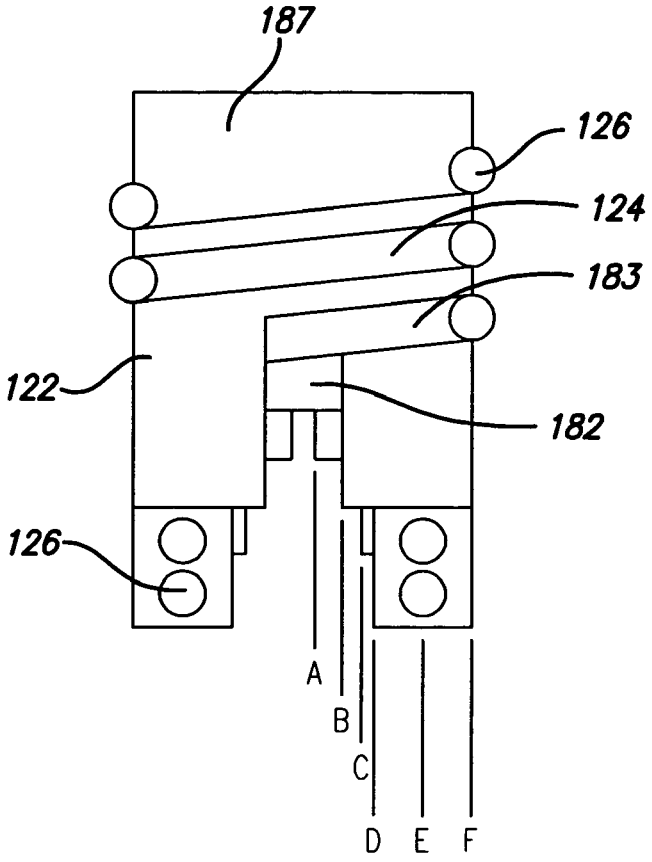
FIG. 3A is a front view of a PC board of the dual band antenna constructed according to the present invention.

In FIGS. 3A and 4A, a center conductor 182 is present traveling upwards along a partial length of the substrate 122 until it approaches approximately the midpoint of the substrate 122. The helix then commences with the helix providing a monopole antenna of resonant frequency and other operating characteristics.

Figure 2:
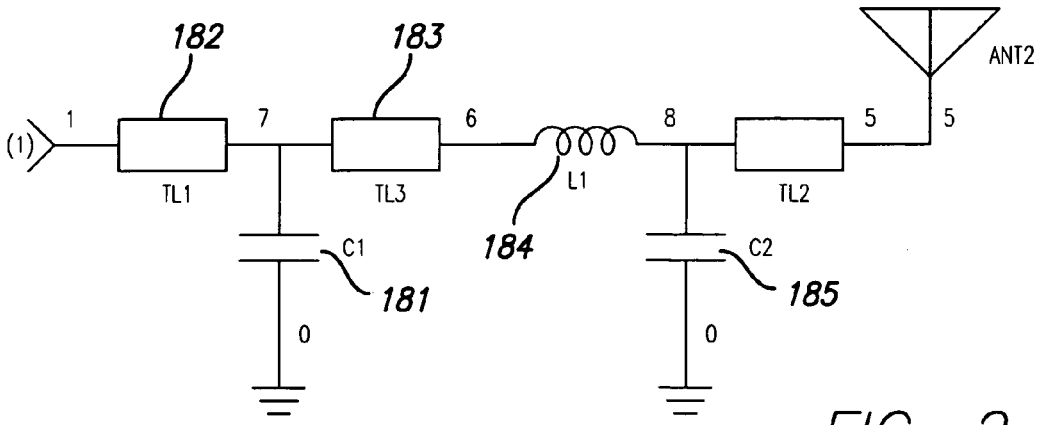
FIG. 2 is a schematic view of a dual band antenna similar to those as shown in the FIGS. 3A–4C.

In FIGS. 4A and 4B, antenna 120 is matched by the combination of the short conductor 182 and a passive component capacitor 181 for one chosen resonant frequency. In one embodiment, the capacitor 181 is an approximately 1.0 picofarad at one kilovolt ceramic capacitor. In conjunction, the conductor 183 and a conducting foil or inductor 184 are matched to a second passive component capacitor 185 to create an overall system resonant frequency for the second selected resonant frequency. The conductive foil 184 may be brass sheeting and manually bent or deformed during testing and/or manufacturing to obtain optimized results as, for example, through the creation of a half-turn inductor as shown in FIG. 4B. The capacitor 185 may be a 1.5 picofarad at one kilovolt ceramic capacitor. Antenna 120 can be better matched and the frequency bandwidth may be broadened when conductor 186 and conductor 187 are subject to increased copper trace thickness and/or height as similarly shown. The schematic in FIG. 2 shows the capacitors 181, 185 and the foil 184 achieving a two-pole low-pass filter, the same being described above.

In FIGS. 4A and 4B, antenna 120 can be easily identified using ink label or silkscreen 188 without destructive interference to the dual-band antenna operating on the two (2) selected frequency.

Figure 3B:
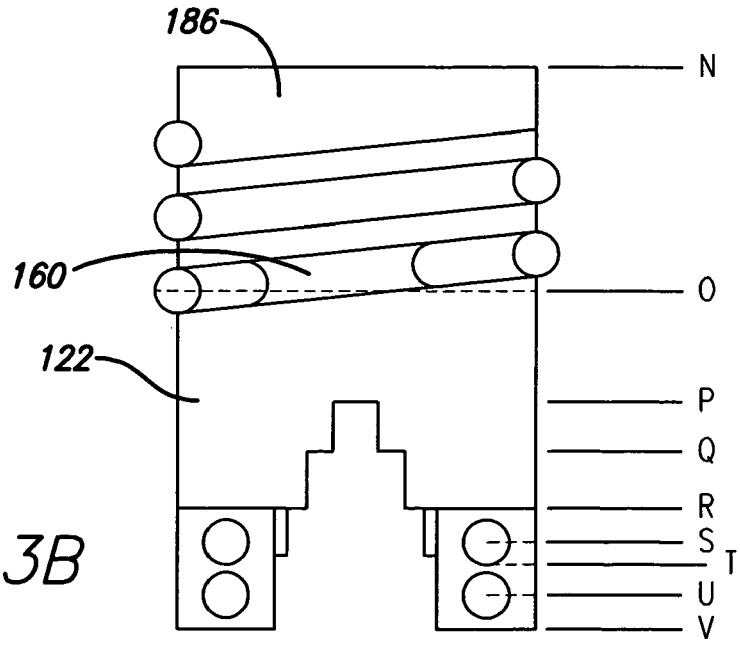
FIG. 3B is a rear view of a PC board of the dual band antenna constructed according to the present invention.

Referring now to FIGS. 3A and 3B, it should be noted that the dimensions of the current antenna are important due to the conduction and electromagnetic radiation transmitted by the antenna. In FIG. 3A, a series of lines A–F are shown at the bottom of the right-hand side of the drawing. These lines correspond to edges that have corresponding counterparts on opposite sides of the central vertical axis of the antenna substrate shown in FIG. 3A.

In FIG. 3B, a series of horizontal lines are shown, N-V, which correspond to the heights of different elements present in the antenna substrate 122. The lines shown on the right-hand side of FIG. 3B.

The following specification distances are provided to enable those of ordinary skill in the art to practice the present invention:

| SEGMENT | DISTANCE |
|---|---|
| A—A | 0.066 inches |
| B—B | 0.190 inches |
| C—C | 0.310 inches |
| D—D | 0.380 inches |
| E—E | 0.610 inches |
| F—F | 0.900 inches |

Generally, the diameter of holes 126 is on the order of 0.075 inches or 0.100 inches. The substrate 122 is approximately 0.062 inches thick and, as can be seen from inspection of the drawings, the conductor 124 is generally the same size as the diameter of the holes, on the order of 0.075 inches to 0.100 inches.

With respect to FIG. 3B:

| SEGMENT | DISTANCE |
|---|---|
| N–V | 1.460 inches |
| O–V | 0.850 inches |
| P–V | 0.595 inches |
| Q–V | 0.455 inches |
| R–V | 0.325 inches |
| S–U | 0.150 inches |
| T–V | 0.200 inches |
| U–V | 0.100 inches |

Certain quality control measurements are seen in Segments A-A, F-F, N-V, and P-V. The distances are approximate and reasonable experimentation may lead those of ordinary skill in the art to obtain optimized results.

FIG. 3B shows a gap 160 interrupting the conductor 124. This gap is bridged by the conducting foil 184 and ensures that there is no parallel conduction path past the conductive foil 184.

Figure 5:
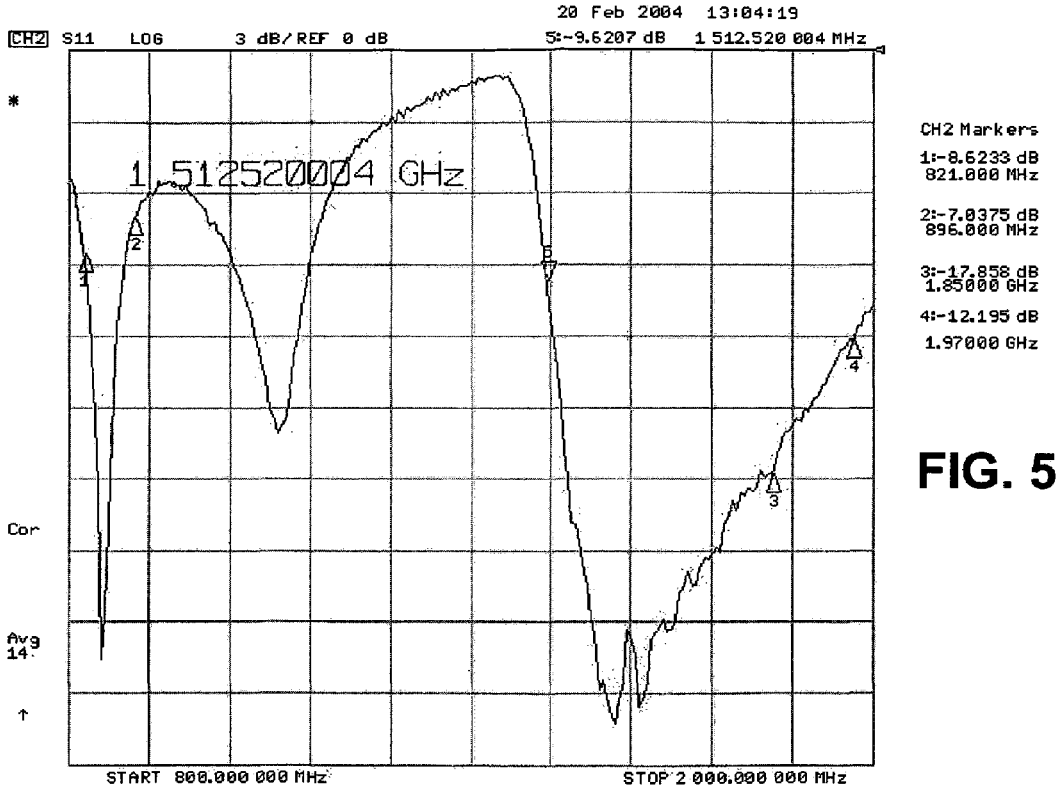
FIG. 5 is a return loss plot of the antenna shown in FIGS. 2–4D. The sweep starts at 800 MHz and stops at 2000 MHz in steps of 120 MHz. Return loss is measured in decibels (dB) with the plot resolved to 3 dB per division. The plot shows two distinct resonant bands (the areas of lowest return loss) with one in the 821–896 MHz range and another in the 1850 to 1990 MHz range.

In FIG. 5, a return loss plot of the low visibility dual band antenna 120 of the present invention is shown. The horizontal scale is in steps of 120 megaHertz (MHz) starting at 800 MHz and ending at 2000 MHz. The vertical scale is in decibels (dB) in steps of 3 dB starting from 0 to −30 db. Two distinct resonant bands are shown, and these resonant bands are the areas of lowest return loss. Lowest return loss means that there is diminished loss due to return and the diminished return generally indicates successful matching of the antenna network to the input transmission line. As indicated in the plot of FIG. 5, two distinct resonant bands are shown with one being in the 821 to 896 MHz range (markers 1 and 2) and the other in the 1850 to 1990 MHz range (markers 3 and 4).

Tuning of the dual band antenna 120 is achieved using a dual matching technique from the two shunt capacitors and a conducting foil or inductor (as illustrated in FIG. 2) at strategic places in the antenna circuit to achieve two resonant frequencies. Also, the two-selected operating frequencies of the antenna can be changed by the thickness of the covering plastic radome 150. This is particularly true if the radome is constructed of a dense plastic such as the Chimei brand of ABS-and/or acetal (often marketed under the brand name of Delrin®) having a dielectric constant of about 4 to 5. ABS (Acrylonitrile Butadiene Styrene) thermoplastic may be used for injection molding the radome that houses the antenna. "T-Grade" ABS to mold mobile antenna radomes has been found to be useful.

Having described the construction, operation, and utility of the present invention, specific embodiments and advantageous features of the antenna of the present invention are set forth in more detail below.

Figure 1A:
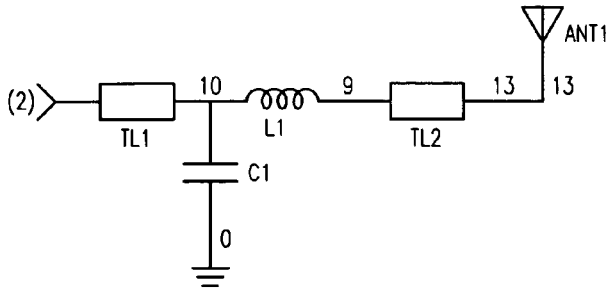
FIG. 1A PRIOR ART
FIG. 1A and FIG. 1B are each a schematic view of prior single band antennae.
Figure 1B:
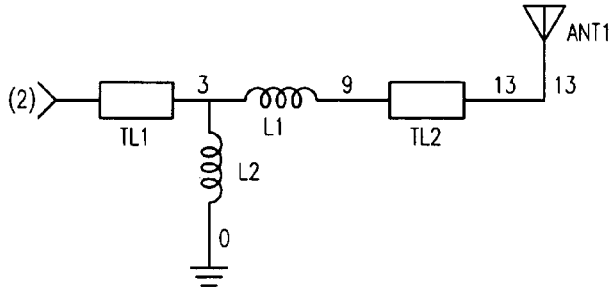
FIG. 1B PRIOR ART

In a previously-realized embodiment realized in conformance with the construction of the predecessor invention, a short UHF antenna was constructed in a three-inch (3") high radome. This antenna, when tuned for a center frequency of 460 MHz, had a 20 MHz bandwidth with a VSWR of 2.0:1. This single band Phantom® antenna circuit model is shown on FIG. 1A. In a second previously-realized embodiment of the present invention, a short and wide bandwidth antenna for the 800–900 MHz frequency range was achieved. This single band 800/900 MHz Phantom®0 antenna circuit model is shown on FIG. 1B. This second antenna uses the geometry similar to that set forth herein and was realized in a one and three-quarter inch (1¾") tall radomed antenna having a 70 MHz bandwidth as required for the duplexed radio bands at 806–869 MHz, 824–896 MHz, and 890–960 MHz. As set forth herein, the new dual band antenna of FIGS. 2–4B, when tuned for a center frequency of 859 MHz, generally has a bandwidth of approximately 75 MHz and when tuned for a center frequency of 1920 MHz, the antenna 120 generally has a bandwidth of approximately 140 MHz and achieves a VSWR <2.0:1 for both bands.

While ground planes are common for the current mobile antennae and small antennae (which the antenna of the present invention may replace), such ground planes are not required for good utility and operation of the present invention. For both bands, the present antenna delivers good performance and signal transmission without a ground plane. Even without a ground plane, the antenna of the present invention has the property of keeping the same VSWR curve with respect to its ground plane and has near equal signal radiation in both the horizontal and vertical planes. This field diversity has been shown to usefully reject reflected interference signals.

The present invention may also be used for sub-miniature antennae for hand-held portable applications. Such antennae can be scaled in size for mounting on hand-held radios, data-modems, and the like. Such radios may be used in factories and warehouses to transmit encoded package information for inventory and shipping control. The present antenna, when mounted on the edge of a ground plane and tuned for the spread spectrum data band, exhibits field diversity.

When used without a ground plane, the horizontal signal strength of an antenna constructed along the lines of the present invention is between 0 and 3 dB below the vertical signal strength over the band. The phases are equal. With a quarter wave antenna, the horizontal signal is typically 17 to 20 dB below the vertical signal strength (−17 to −20 dB), showing the enhanced utility, performance, and operation of the antenna of the present invention.

With respect to 70 MHz bandwidth antennae, field diversity is better obtained when such antennae are mounted on the edge of the ground plane as opposed to the ground plane's center.

Figure 4D:
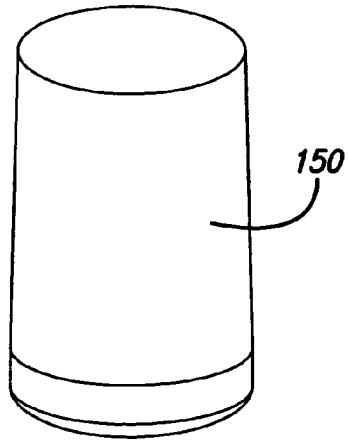
FIG. 4D shows the radome, or outer covering, for the dual band antenna constructed according to the present invention.

In an additional embodiment of the present invention, antennae constructed according to the present invention may be stacked to provide an end-fed collinear antenna array (FIG. 4D). Such an array may be driven using a phase shift network 194 to increase the utility and benefits of the antenna of the present invention.

The response curve characteristics of antennae constructed according to the present invention include flat response curves and easily realizable manufacturing techniques. Prior to the invention of the present antenna, the performance characteristics in the band regimes addressed by the present antenna had not previously been sought or achieved. The cross-polarization, or polarization diversity, achieved by the present invention provides very reliable communications diminishing the interference patterns creating Raleigh/signal fading and dead spots. In fact, radio transmitters using antennae constructed along the lines of the present invention have been used to good advantage by stock cars racing under the auspices of the National Association for Stock Car Auto Racing (NASCAR). However, due to aerodynamic requirements, these antennae are no longer currently in use, but performed well. Additionally, other stock car racing circuits allow the use of the antenna and have found it to also perform successfully.

Other applications of the antenna include wireless meter reading, wireless inventory control collection points, wireless identification systems, and other voice and/or data transmission systems.

While the present invention has been described with regards to particular embodiments, it is recognized that additional variations of the present invention may be devised without departing from the inventive concept.

What is claimed is:

1. A low-visibility, field-diverse dual band monopole antenna for providing communications comprising:

an antenna-supporting core comprising printed circuit board (PCB) substrate and having a width and a length;

an antenna, said antenna wrapped upon said core in a manner for two selected dual band resonant frequencies, said antenna radiating in a diverse manner with horizontal and vertical field components of a field radiated by said antenna substantially in phase and not circularly polarized;

said antenna including a two-pole low-pass filter that enables operation at said two selected resonant frequencies, said two-pole low-pass filter including three passive components that enable operation at said two selected resonant frequencies; and said three passive components including:

an adjustable conducting foil acting as an inductor, said conducting foil enabling operation at said two selected resonant frequencies; and a first capacitor and a second capacitor system selected from the group consisting of: first and second capacitors matching the remainder of the circuit to enable operation at said two selected resonant frequencies, first and second capacitors coupled to a tuning inductor to enable operation at two selected resonant frequencies, first and second capacitors coupled to a micro-strip to enable operation at said two selected resonant frequencies, and combinations thereof; whereby the low-visibility, field-diverse dual band antenna is realized having helical antenna characteristics without severe circular polarization radiation thereby promoting reliable communications.

2. The low-visibility, field-diverse, dual band monopole antenna of claim 1, wherein said two selected resonant frequencies comprise PCS/Cellular frequencies at 821–896 MHz and 1850–1990 MHz.

3. The low-visibility, field-diverse dual band monopole antenna of claim 1, wherein said three passive components comprise said first and second capacitors separated by said conducting foil and matching to enable operation at said two selected resonant frequencies.

4. The low-visibility, field-diverse antenna of claim 1, wherein said antenna is wrapped upon said core in a helical manner.

5. The low-visibility, field-diverse antenna of claim 1, wherein said antenna comprises a meandering conductor wrapped upon said core.

6. The low-visibility, field-diverse antenna of claim 1, further comprising:

a radome covering said core and said antenna.

7. The low-visibility, field-diverse antenna of claim 6, wherein said radome comprises a dense plastic, said dense plastic changing the operating frequency of the antenna.

8. The low-visibility, field-diverse antenna of claim 7, wherein said dense plastic has a dielectric constant of approximately 4.

9. The low-visibility, field-diverse antenna of claim 8, wherein said dense plastic is selected from the group of materials consisting of acetal and ABS.

10. The low-visibility, field-diverse antenna of claim 6, wherein said radome is approximately three inches tall, said antenna is tuned for center frequencies of 859 MHz and 1920 MHz with respective bandwidths of 75 MHz and 140 MHz, both with a VSWR of approximately 2.0:1.

11. The low-visibility, field-diverse antenna of claim 6, wherein said radome is approximately one and three-quarter inches (1¾") tall, said antenna is tuned for center frequencies of 859 MHz and 1920 MHz with respective bandwidths of 75 MHz and 140 MHz, both with a VSWR of approximately 2.0:1.

12. The low-visibility, field-diverse antenna of claim 1, wherein the low-visibility, field-diverse antenna is one in a stack of similar antennas coupled by a phase-shift network creating an end-fed collinear antenna.

13. A low-visibility, field-diverse dual band monopole antenna for providing communications comprising an antenna-supporting core comprising printed circuit board (PCB) substrate and having a width and a length; and an antenna, said antenna wrapped upon said core in a manner for two selected dual band resonant frequencies, said antenna radiating in a diverse manner with horizontal and vertical field components of a field radiated by said antenna substantially in phase and not circularly polarized, said antenna including a two-pole low-pass filter that enables operation at said two selected resonant frequencies, said two-pole low-pass filter including:

a first capacitor shunted, to ground and in parallel to an input to the antenna;

an adjustable inductor coupled to said first capacitor and in series with said input; and a second capacitor coupled to said adjustable inductor on a side of said adjustable inductor opposite that of said input, said second capacitor shunted to ground and in parallel to said first capacitor; whereby said two selected resonant frequencies are enabled for transmission by the antenna; whereby the low-visibility, field-diverse dual band antenna is realized having helical antenna characteristics without severe circular polarization radiation thereby promoting reliable communications.

14. The low-visibility, field-diverse dual band monopole antenna of claim 13, further comprising:

said first capacitor is an approximately 1 pf at 1 kV ceramic capacitor;

said adjustable inductor is a manually-adjustable brass ribbon or sheet; and said second capacitor is an approximately 1.5 pf at 1 kV ceramic capacitor.

15. A low-visibility, field-diverse dual band monopole antenna for providing communications comprising:

an antenna-supporting core being generally thin and rectangular and comprising printed circuit board (PCB) substrate and having a width and a length; and an antenna, said antenna wrapped upon said core in a manner for two selected dual band resonant frequencies, said antenna radiating in a diverse manner with horizontal and vertical field components of a field radiated by said antenna substantially in phase and not circularly polarized, said antenna including a two-pole low-pass filter that enables operation at said two selected resonant frequencies: whereby the low-visibility, field-diverse dual band antenna is realized having helical antenna characteristics without severe circular polarization radiation thereby promoting reliable communications.

16. The low-visibility, field-diverse antenna of claim 15, wherein said generally rectangular shape of said antenna-supporting core approximates a square.

17. The low-visibility, field-diverse antenna of claim 15, wherein said PCB substrate conducts from one flat side to another via at least a portion of a plated-through hole.

18. The low-visibility, field-diverse antenna of claim 17, wherein said antenna comprises conducting foil.

19. A low-visibility, field-diverse antenna for providing communications, comprising:

a generally thin and approximately square antenna-supporting core comprising printed circuit board (PCB) substrate having a width and a length, said core conducting from one flat side to another via at least a portion of a plated-through hole in said core;

an antenna, said antenna comprising conducting foil fixed upon said core in a manner for two selected dual band resonant PCS/Cellular frequencies at 821–896 MHz and 1850–1990 MHz, said antenna radiating in a diverse manner with horizontal and vertical field components of a field radiated by said antenna are substantially in phase and not circularly polarized;

said antenna having a two-pole low-pass filter that enables operation at said two selected resonant frequencies, including a first capacitor shunted to ground and in parallel to an input to the antenna, an adjustable inductor coupled to said first capacitor and in series with said input, and a second capacitor coupled to said adjustable inductor on a side of said adjustable inductor opposite that of said input, said second capacitor shunted to ground and in parallel to said first capacitor such that said two selected resonant frequencies are enabled for transmission by the antenna;

said first capacitor being an approximately 1 pf at 1 kV ceramic capacitor, said adjustable inductor being a manually-adjustable brass ribbon or sheet, and said second capacitor being an approximately 1.5 pf at 1 kV ceramic capacitor; and said antenna terminating in an extended area of conductor having a width generally greater than that of said conducting foil, said extended area covering an end of said antenna-supporting core; whereby the low-visibility, field-diverse dual band antenna is realized having helical antenna characteristics without severe circular polarization radiation thereby promoting reliable communications.

20. A low-visibility, field-diverse antenna for providing communications as set forth in claim 19, further comprising:

a radome, said radome covering said core and said antenna, said radome comprising materials selected from the group of acetal and ABS plastics, said radome having a dielectric constant of approximately 4 and changing the operating frequency of the antenna.

21. A method for constructing a low-visibility, field-diverse dual band monopole antenna, the steps comprising:

providing an antenna-supporting core;

providing a conductor;

fixing said conductor upon said core;

attaching said conductor to said core in a manner whereby a length of said conductor is engaged by said core in a manner for two selected dual band resonant frequencies, said conductor radiating in a diverse manner with horizontal and vertical field components of a field radiated by said conductor substantially in phase and not circularly polarized; and coupling a two-pole low-pass filter to said conductor, said two-pole low-pass filter enabling operation at said two selected resonant frequencies, said two-pole low-pass filter including three passive components that enable operation at said two selected resonant frequencies;

said three passive components including:

an adjustable conducting foil acting as an inductor, said conducting foil enabling operation at said two selected resonant frequencies and a first capacitor and a second capacitor system selected from the group consisting of: first and second capacitors matching the remainder of the circuit to enable operation at said two selected resonant frequencies, first and second capacitors coupled to a tuning inductor to enable operation at two selected resonant frequencies, first and second capacitors coupled to a micro-strip to enable operation at said two selected resonant frequencies, and combinations thereof; whereby the low-visibility, field-diverse dual band antenna is realized having helical antenna characteristics without severe circular polarization radiation thereby promoting reliable communications.

22. The method for constructing a low-visibility, field-diverse dual band monopole antenna of claim 21, wherein said two selected resonant frequencies comprise:

PCS/Cellular frequencies at 821–896 MHz and 1850–1990 MHz.

23. The method for constructing a low-visibility, field-diverse dual band monopole antenna of claim 21, wherein said three passive components comprise said first and second capacitors separated by said conducting foil and matching to enable operation at said two selected resonant frequencies.

24. The method for constructing a low-visibility, field-diverse antenna of claim 21, wherein the step of providing an antenna-supporting core further comprises:

providing an antenna-supporting core having plated-through holes whereby conduction can be made from one side of said antenna-supporting core to another.

25. The method for constructing a low-visibility, field-diverse antenna of claim 24, wherein the step of attaching said conductor to said core further comprises:

attaching conducting foil on one side of said core connecting one plated-through hole with another.

26. The method for constructing a low-visibility, field-diverse antenna of claim 25, wherein the step of providing an antenna-supporting core further comprises:

said plated-through holes are present on opposite sides of said core, said plated-through holes on one side of said core are offset with respect to said plated-through holes on the other side of said core to establish a pitch of said conducting foil attaching a plated-through hole on one side of said core with a plated-through hole on the other side of said core.

27. The method for constructing a low-visibility, field-diverse antenna of claim 26, wherein said offset of said plated-through holes is selected to maintain resonance in conjunction with a length of said conductor.

28. The method for constructing a low-visibility, field-diverse antenna of claim 26, wherein the step of providing an antenna-supporting core further comprises:

providing an antenna-supporting core having plated-through holes inside a perimeter margin.

29. The method for constructing a low-visibility, field-diverse antenna of claim 28, the steps further comprising:

removing excess core material by removing said perimeter margin to create a minimally-sized antenna.

30. The method for constructing a low-visibility, field-diverse antenna of claim 29, wherein said plated-through holes are approximately one hundred-thousandths inch (0.100") in diameter.

31. A method for constructing a low-visibility, field-diverse dual band monopole antenna, the steps comprising providing an antenna-supporting core;

providing a conductor;

fixing said conductor upon said core;

attaching said conductor to said core in a manner whereby a length of said conductor is engaged by said core in a manner for two selected dual band resonant frequencies, said conductor radiating in a diverse manner with horizontal and vertical field components of a field radiated by said conductor substantially in phase and not circularly polarized; and coupling a two-pole low-pass filter to said conductor, said two-pole low-pass filter enabling operation at said two selected resonant frequencies, said two-pole low-pass filter including:

a first capacitor shunted to ground and in parallel to an input to the antenna;

an adjustable inductor coupled to said first capacitor and in series with said input; and a second capacitor coupled to said adjustable inductor on a side of said adjustable inductor opposite that of said input, said second capacitor shunted to ground and in parallel to said first capacitor; whereby said two selected resonant frequencies are enabled for transmission by the antenna; whereby the low-visibility, field-diverse dual band antenna is realized having helical antenna characteristics without severe circular polarization radiation thereby promoting reliable communications.

32. The method for constructing a low-visibility, field-diverse dual band monopole antenna of claim 31, further comprising:

said first capacitor is an approximately 1 pf at 1 kV ceramic capacitor;

said adjustable inductor is a manually-adjustable brass ribbon or sheet; and said second capacitor is an approximately 1.5 pf at 1 kV ceramic capacitor.

* * * * *